US006081175A

United States Patent [19]

Duong et al.

[11] Patent Number: 6,081,175

[45] Date of Patent: Jun. 27, 2000

[54] COUPLING STRUCTURE FOR COUPLING CAVITY RESONATORS

[75] Inventors: Frank T. Duong, Edison; Bill Engst, Sayreville; Gregory J. Lamont, Jackson; Chi Wang, Middletown, all of N.J.

[73] Assignee: Radio Frequency Systems Inc., Marlboro, N.J.

[21] Appl. No.: 09/151,365

[22] Filed: Sep. 11, 1998

[51] Int. Cl.[7] ..... H01P 1/208

[52] U.S. Cl. ..... 333/212; 333/230; 333/219.1

[58] Field of Search ..... 333/202, 208, 333/209, 212, 230, 219.1

[56] References Cited

U.S. PATENT DOCUMENTS

| | | | |
|---|---|---|---|
| 4,777,459 | 10/1988 | Hudspeth | 333/212 X |
| 4,812,790 | 3/1989 | Tatomir et al. | 333/212 |
| 5,781,085 | 7/1998 | Harrison | 333/212 X |
| 5,886,594 | 3/1999 | Guglielmi et al. | 333/208 |

FOREIGN PATENT DOCUMENTS

| | | | |
|---|---|---|---|
| 6-13801 | 1/1994 | Japan | 333/202 |
| 7-336103 | 12/1995 | Japan . | |
| 799163 | 8/1958 | United Kingdom | 333/212 |

OTHER PUBLICATIONS

"The Design of Band–Pass Filters Made of Dielectric and Coaxial Resonators," Hee–yong Hwang et al, 1997 IEEE MTT–S Digest, pp. 805–808.

"Microwave Dielectric–Resonator Filters," S.B. Cohn and E.N. Torgow, U.S. Arym Electronic Laboratories, Nov. 1964, pp. 7–11.

"High Q TE01 Mode DR Cavity Filters for Wireless Base Stations," Liang and Blair, 1998 IEEE MTT–S Digest, pp. 825–828.

"Reducing Spurious Responses," http://www.rfglobalnet-.com/library/penton/archives/mrf/sep. 1997/473.htm.

*Primary Examiner*—Robert Pascal
*Assistant Examiner*—Barbara Summons
*Attorney, Agent, or Firm*—Ware, Fressola, Van Der Sluys & Adolphson LLP

[57] ABSTRACT

A coupling structure for coupling two resonant cavities, which may be dissimilar, based on providing a metallic surface, called here a guide surface, at an angle intermediate between the orientation of the magnetic field in the two cavities. The guide surface may be one surface of a non-rectangular window cut in a wall separating the two cavities or may be the surface of a coupling screw piercing, at the intermediate angle, a rectangular window in a wall between the two cavities. In the non-rectangular window embodiment, an adjusting tuning screw is provided that screws into a notch in the guide surface. In the angled coupling screw embodiment, coupling is adjusted by providing that more or less of the angled coupling screw extends into the rectangular window. The coupling structure couples any two cavities having mutually orthogonal magnetic fields by providing the guide surface at an orientation so the magnetic field in each cavity has a non-zero projection onto the guide surface.

9 Claims, 5 Drawing Sheets

COUPLING STRUCTURE FOR COUPLING CAVITY RESONATORS

FIELD OF THE INVENTION

The present invention pertains to coupled cavity electromagnetic resonators, and in particular, to a coupling structure for coupling physically adjacent cavities so that electromagnetic field energy can flow from one cavity resonator to a physically adjacent cavity resonator, especially in the case where the magnetic field component of the electromagnetic field in one cavity is orthogonal to the magnetic field in the other cavity.

BACKGROUND OF THE INVENTION

Cavity resonators in good conductors can be fashioned so that only certain combinations of electric and magnetic fields can exist within the cavity. Such cavities are useful because they can filter out electromagnetic field energy at undesired frequencies.

A resonant cavity can be structured so that only particular modes of an electromagnetic field are utilized within the cavity. A dielectric post or metallic post is sometimes provided within the cavity, with its longitudinal axis extending out from a sidewall of the cavity, so as to be substantially perpendicular to the direction of flow of electromagnetic field energy within the cavity. Such posts impose behavior (expressed as boundary conditions) on the electric and magnetic fields, in addition to the behavior imposed by the electrically conducting metallic material of the cavity walls. The term dielectric post is used here to mean a dielectric (e.g. ceramic) puck (i.e. a short cylinder of ceramic material) held away from a wall of the cavity by a support; the longitudinal axis of the dielectric puck is substantially perpendicular to the direction of flow of electromagnetic field energy within the cavity.

Depending on the type of resonator, i.e. whether the post material is metallic or dielectric, one or another behavior is imposed on the electric and magnetic fields. If the material is metallic and the cavity is operating in transverse electric and magnetic field (TEM) mode, the electric field within the cavity, besides being normal (perpendicular) to every (electrically conducting) cavity wall, or vanishing at such a wall, must also be normal to the surface of the metallic post, or must vanish at the surface of the post. The magnetic field, on the other hand, has only an azimuthal non-zero component within the cavity, taking the lengthwise axis of the post to be the axis about which the azimuthal angle is measured. (Thus, the electric field is zero within the post and normal to every surface within the cavity, including the surface of the metallic post, while the magnetic field is also zero within the post but runs circumferentially around the post.)

If the post material is a dielectric, such as a ceramic, on the other hand, the cavity can resonate in a transverse electric (TE) mode, in particular the $TE_{011}$ mode. In such a mode, in a cavity with a ceramic post (i.e. a ceramic puck plus a spacer) having a longitudinal axis extending away from a sidewall of the cavity, the electric field will be purely azimuthal with respect to the center line axis of the ceramic post and largest within the ceramic post, and because the walls of the cavity are metallic, will decrease in intensity away from the ceramic post, vanishing at the walls of the cavity. The magnetic field, on the other hand, is everywhere orthogonal (perpendicular) to the electric field and has a radial component proportional to the electric field (although 90° out of phase). Thus, the magnetic field will be largest within the ceramic post and will have no azimuthal component (with respect to the axis of the ceramic post) anywhere in the cavity.

A filter based on a metallic resonator has different performance characteristics from a filter based on a dielectric (ceramic) resonator. In particular, ceramic resonators generally provide poor spurious performance compared to a metallic resonator, and a metallic resonator is usually less expensive. A ceramic resonator on the other hand is superior to a metallic resonator in its passband performance, due to the higher quality factor of a ceramic resonator. Thus, it is desirable to build filters using both kinds of cavity resonators, i.e. dissimilar cavities, and so to obtain a filter combining the better qualities of each kind of cavity resonator.

Unfortunately, as is evident from the above description of the electric and magnetic fields in the two different kinds of resonators, if a ceramic cavity is physically adjacent a metallic cavity, and no special structure is used to couple the two cavities, then the axis of the ceramic post in the ceramic cavity must be perpendicular to the axis of the metallic post in the metallic cavity (and also perpendicular to the direction of flow of energy from one end of the filter cavity to the other) so that the magnetic fields or the electric fields in the two cavities align. If this is not done, there can be no flow of energy between the cavities because the magnetic field and electric field in the second cavity can only exist in an orientation not possible in the first cavity.

The prior art, as shown in FIGS. 2–4, sometimes arranges physically adjacent cavities so that the possible magnetic field orientations in the two cavities have some mutual components (with respect to a single frame of reference). In FIGS. 2–4, a filter according to the prior art is shown made from a ceramic resonator 16 coupled by a coupling structure 18 to a metallic resonator 17, and having ports 25. The electromagnetic energy flows from one port through the cavity to the other port. The ceramic resonator 16 has a ceramic puck 11 spaced apart from a sidewall of the ceramic resonator cavity wall 20 using a support 19. The metallic resonator 17 includes a metallic post 12 and capacitive screw 13 (FIG. 2 only). The metallic post 12 is affixed to a wall 21 of the metallic resonator cavity, and the capacitive screw 13 is threaded through the opposite wall 22. With this relative arrangement of the posts 11 and 12, the magnetic field in the two cavities 16 and 17 is aligned, i.e. has some same non-zero components. Thus, the coupling structure 18, separating the two cavities 16 and 17 with a metallic wall 15 having an aperture 14, need only provide a direct path for the electromagnetic field from one cavity 16 or 17 to the other, because the magnetic field in one cavity is already partially aligned with the magnetic field in the other cavity.

This arrangement, although useful, has the drawback that the mechanical layout of one cavity fixes that of the physically adjacent cavity, and in the case of a multistage filter consisting of one or another combination of three or more cavities of dissimilar types, can lead to annoying complications.

The prior art uses other means of coupling dissimilar cavities besides mechanically orienting physically adjacent cavities. These other methods focus on aligning either the electric field, using a probe-to-probe coupling structure to draw the electric field from one cavity into an orientation suitable for the physically adjacent cavity, or aligning the magnetic field, using a loop-to-loop coupling structure. Besides these aligning-type coupling structures, the prior art uses a probe-to-loop coupling structure to have the electric field in one cavity produce a current in a loop extending into the physically adjacent cavity and so produce a magnetic field in the physically adjacent cavity oriented in a way suitable for the physically adjacent cavity by properly orienting the loop. These probe and loop structures are of use, however, only for relatively narrow bandwidth filters because the electric coupling they provide is relatively weak.

What is needed is a coupling structure for coupling dissimilar resonators that couples, relatively strongly, the dissimilar resonators without fixing the relative orientations of the dissimilar resonators.

SUMMARY OF THE INVENTION

The present invention is a coupling structure, for coupling the electromagnetic field in physically adjacent cavity resonators where the magnetic field in one cavity resonator is orthogonal to the magnetic field in the other cavity resonator. The coupling structure of the present invention is a conducting surface, called here a guide surface, oriented between the physically adjacent cavities in such a way that the magnetic field in each cavity has a non-zero projection onto the guide surface. Thus, the magnetic field in one cavity is communicated to the other cavity, and so also the accompanying electric field.

The present invention is of particular use in coupling dissimilar cavity resonators where each cavity resonator has a post with an axis extending out from a same sidewall of the cavity. In a first embodiment, the coupling structure has a coupling window cut in a non-rectangular shape in a wall separating the dissimilar resonator cavities, so that at least one edge surface of the coupling window, called here a guide surface, extends for at least some length non-parallel to the posts in both cavities.

In another aspect of the present invention, a coupling structure with such a non-rectangular window includes in the guide surface a notch and provides a tuning screw that extends toward the notch from an outside edge surface of the coupling structure, and that can be screwed more or less into the notch by turning or otherwise applying force to the end of the tuning screw extending from inside the coupling window to beyond the outside edge surface of the coupling structure. A notch is not necessary but makes the tuning screw much more effective, by conforming the magnetic field within the notch to the surface of the tuning screw extending into the notch. The guide surface of the coupling window is thus oriented so as to extend in a direction in which the magnetic field in both physically adjacent, dissimilar cavities has a non-zero projection, and so provides coupling between the cavities. Moreover, the guide surface alters the behavior of the electric and magnetic field nearby so as to essentially blend the magnetic field in one cavity into the orientation allowed in the other cavity. Thus, the coupling provided by the present invention is, in principle, stronger than that provided by the probe and loop couplings of the prior art, and therefore useful in the filters that must provide a wider bandwidth.

If the posts of the dissimilar resonator cavities are mechanically arranged to provide coupling as in the prior art, the coupling window of the present invention ends up the same as the (rectangular) coupling windows used in the prior art. (See FIGS. 2–5).

In another aspect of the present invention, the coupling window is rectangular and a magnetic field in the two dissimilar cavities is coupled using only a coupling screw, but angled at some non-zero angle relative to the axes of the (parallel) posts in each of the two cavities. The coupling is increased by turning the angled coupling screw so that it penetrates farther into the rectangular window between the two cavities.

The principle here is the same as in the first embodiment. The magnetic field at the coupling structure lies tangential to the surface of the coupling screw so that the angled coupling screw both communicates the non-zero projection of the magnetic field onto the axial direction of the angled coupling screw, and also deforms the magnetic field in the two cavities, near the coupling structure, from the geometry each would have without coupling, so as to blend the magnetic field of one cavity into that of the other.

The coupling structure of the present invention is of use in coupling any two cavities where the magnetic field in one cavity is orthogonal to the magnetic field in the other cavity; the cavities need not be dissimilar in the sense described above. A coupling structure according to the present invention provides a guide surface oriented in any of the various ways possible for the magnetic field in each cavity to have a non-zero projection onto the guide surface. Thus, the magnetic field in one cavity is twisted or reoriented by the guide surface in such a way as to appear also in the other cavity.

BRIEF DESCRIPTION OF THE DRAWINGS

The above and other features and advantages of the invention will become apparent from a consideration of the subsequent detailed description presented in connection with accompanying drawings, in which.

DESCRIPTION OF THE PREFERRED EMBODIMENT

Figure 1A:
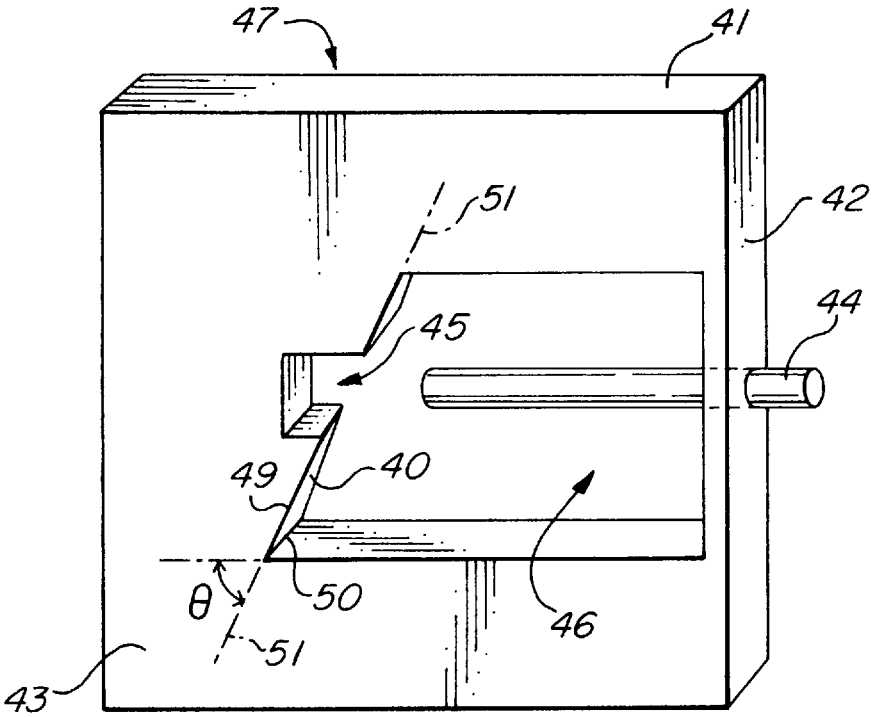
FIG. 1A is a perspective drawing of a coupling structure according to the present invention based on the non-rectangular coupling window.

Referring now to FIG. 1A and FIGS. 6–9, a coupling structure 47 is shown coupling a ceramic resonator 16 to a metallic resonator 17', the combination of these cavity resonators acting as a filter having port 25. The ceramic resonator 16 has a ceramic post (puck) 11 supported in spaced relation from a sidewall of the cavity by a support 19. The metallic resonator 17' has a metallic post 12' with a base joining a side of the wall 21' of the metallic resonator cavity. These dissimilar cavity resonators are the same as in the prior art (FIGS. 2–5) but are mechanically arranged in a different spatial relationship. Where the axes of the posts 11 and 12 in the two cavities of the prior art (FIGS. 2–5) are mutually perpendicular, in FIGS. 6–9, the axes are parallel. Therefore, a special coupling structure is needed to twist or reorient the magnetic field from its orientation in one cavity into an orientation or mode in which it can exist in the physically adjacent cavity.

The coupling structure 47 provides the required reorientation by virtue of the guide surface 40 cut into a partition 43 as one edge surface of a non-rectangular coupling window 46. The guide surface 40 has a major axis 49 (i.e. the longer axis compared to the minor or shorter axis 50), lying along line 51, that is cut at a coupling angle θ with respect to the direction of the axes of the two parallel posts 11 and 12' in the filter, one in each cavity. Thus the major axis 49 lies in the plane of the partition window but at a non-zero angle less than 90° with respect to the sidewalls 20, 21' of the filter cavities. In the preferred embodiment, this coupling angle θ is approximately 45°, and because the undistorted magnetic field in one cavity is at 90° to the magnetic field in the other cavity, the guide surface 40 reorients the magnetic field in both cavities, near the coupling structure, by approximately 45° so that the magnetic field in either cavity is nearly parallel to the magnetic field in the other cavity, at least in the immediate vicinity of the guide surface.

Although the orientation of the coupling structure shown in FIGS. 6–9 aligns the magnetic field in the two cavities in a positive sense, by rotating the coupling structure through 90°. Alternatively, the side of the coupling structure from which the angled cut begins can be changed from side 41 to side 42. In either case, instead of providing positive coupling as provided by the embodiment shown in FIGS. 6–9, the magnetic filed is aligned in the opposite sense, providing negative coupling.

In another aspect of the present invention, the coupling structure includes a notch 45 and a tuning screw 44 piercing part of the coupling structure wall from an outside edge surface into the coupling window 46 and extending toward and possibly into the notch 45. This notch/tuning screw refinement of the basic coupling structure 47 allows adjusting the coupling between the dissimilar cavities. The notch/tuning screw provides a capacitance, made larger by the notch, which reorients the magnetic field along the axis of the tuning screw. The capacitance of the notch/tuning screw reduces attenuation of the electromagnetic field energy in moving from one cavity to the other. In some implementations of the coupling structure with a non-rectangular window and an adjusting notch/tuning screw, an adjustment in coupling by as much as 30% has been achieved.

Figure 1B:
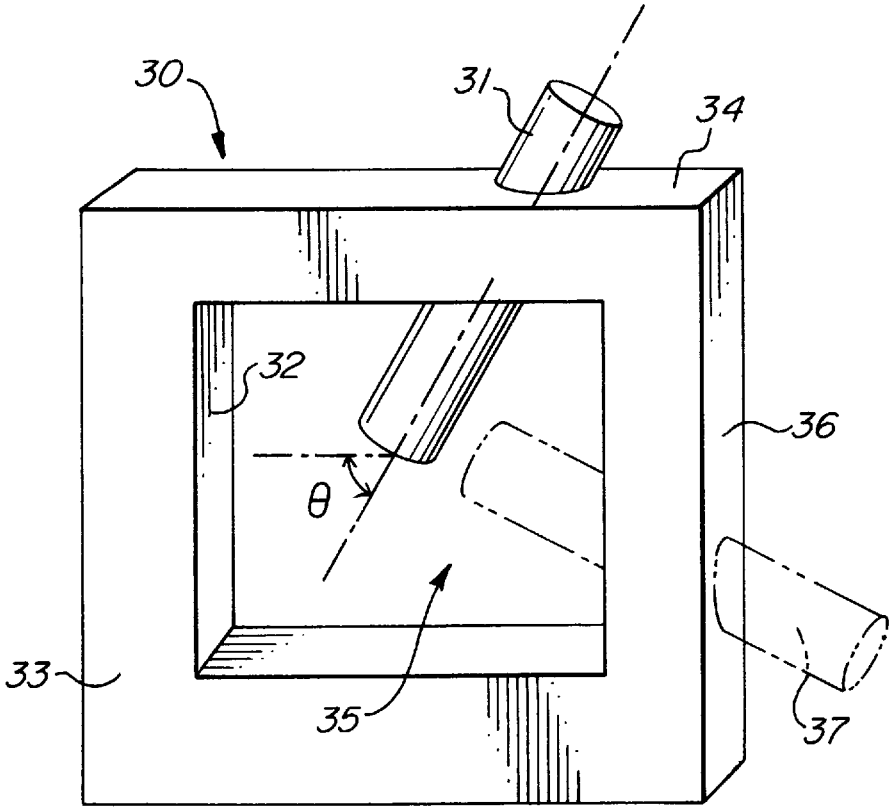
FIG. 1B is a perspective drawing of a coupling structure according to the present invention based on the angled coupling screw.
Figure 2:
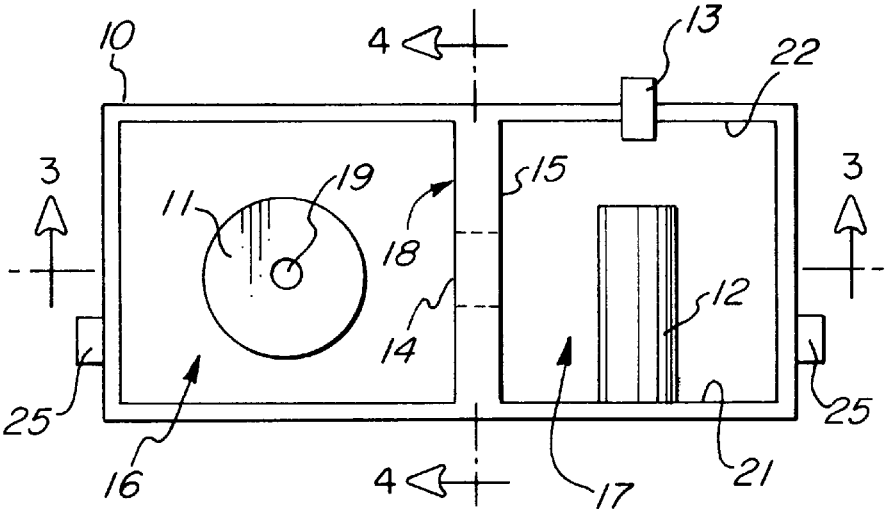
FIG. 2 (PRIOR ART)
FIGS. 2–4 are different cross-sectional views of coupled dissimilar resonators with a coupling structure according to the prior art.
Figure 3:
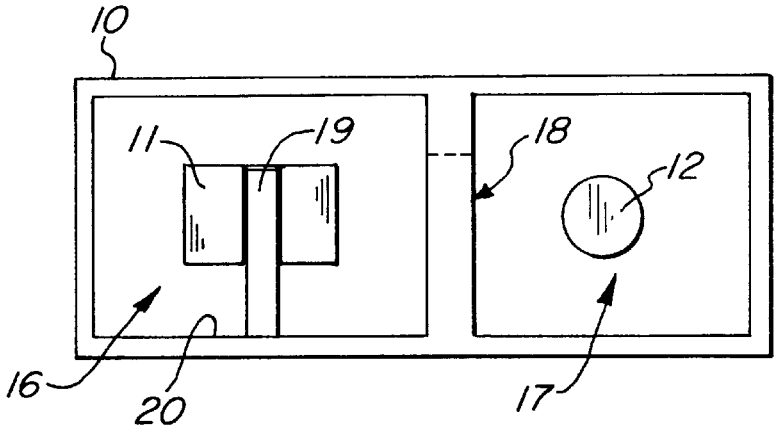
FIG. 3 (PRIOR ART)
Figure 4:
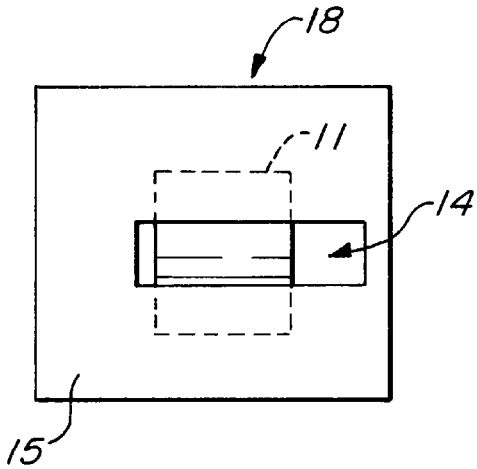
FIG. 4 (PRIOR ART)
Figure 5:
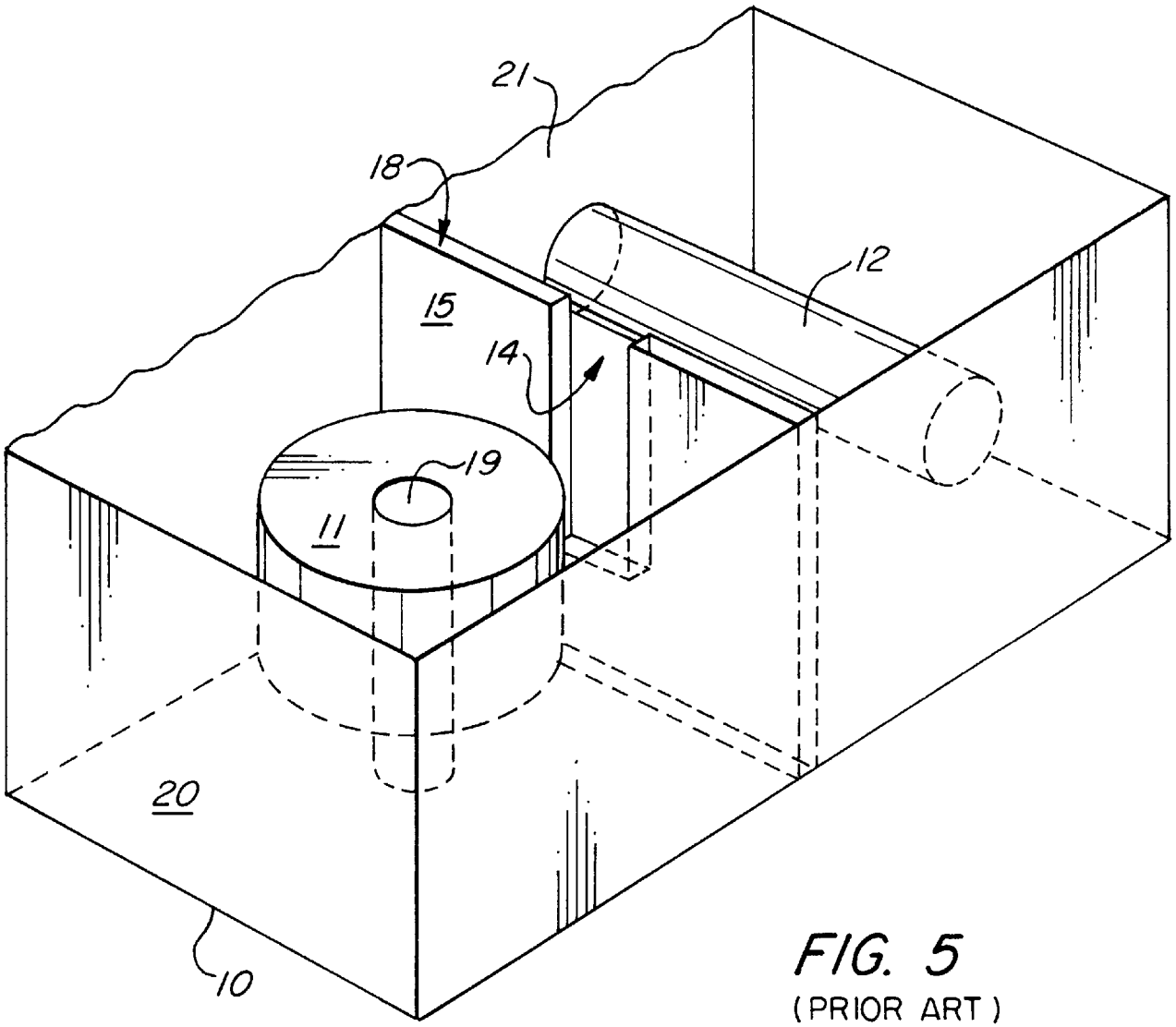
FIG. 5 (PRIOR ART)
FIG. 5 is a perspective drawing corresponding to the cross-sectional views of FIGS. 2–4.
Figure 6:
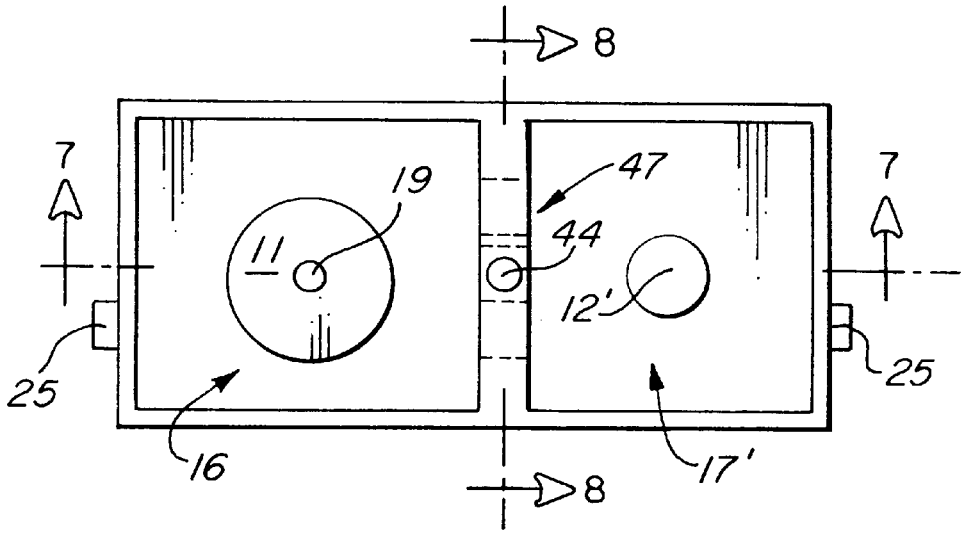
FIGS. 6–8 are different cross-sectional views of coupled dissimilar resonators with a coupling structure according to the present invention.
Figure 7:
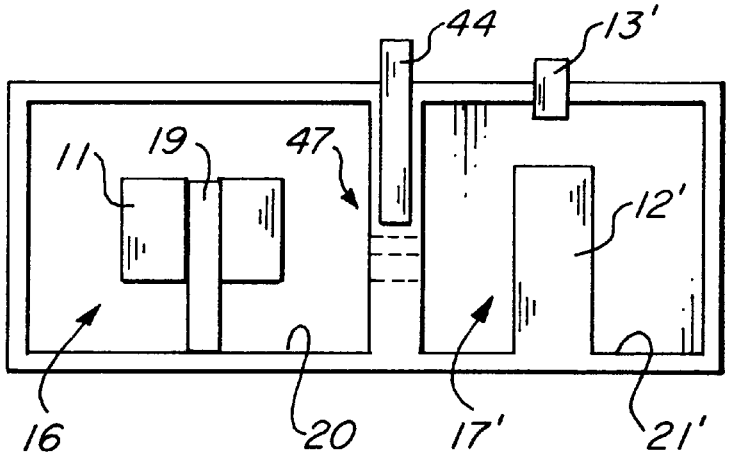
Figure 8:
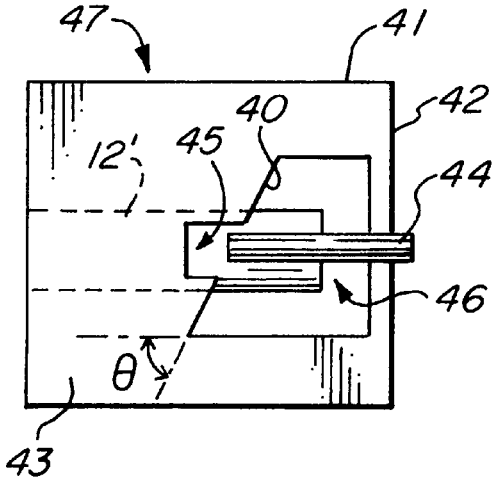
Figure 9:
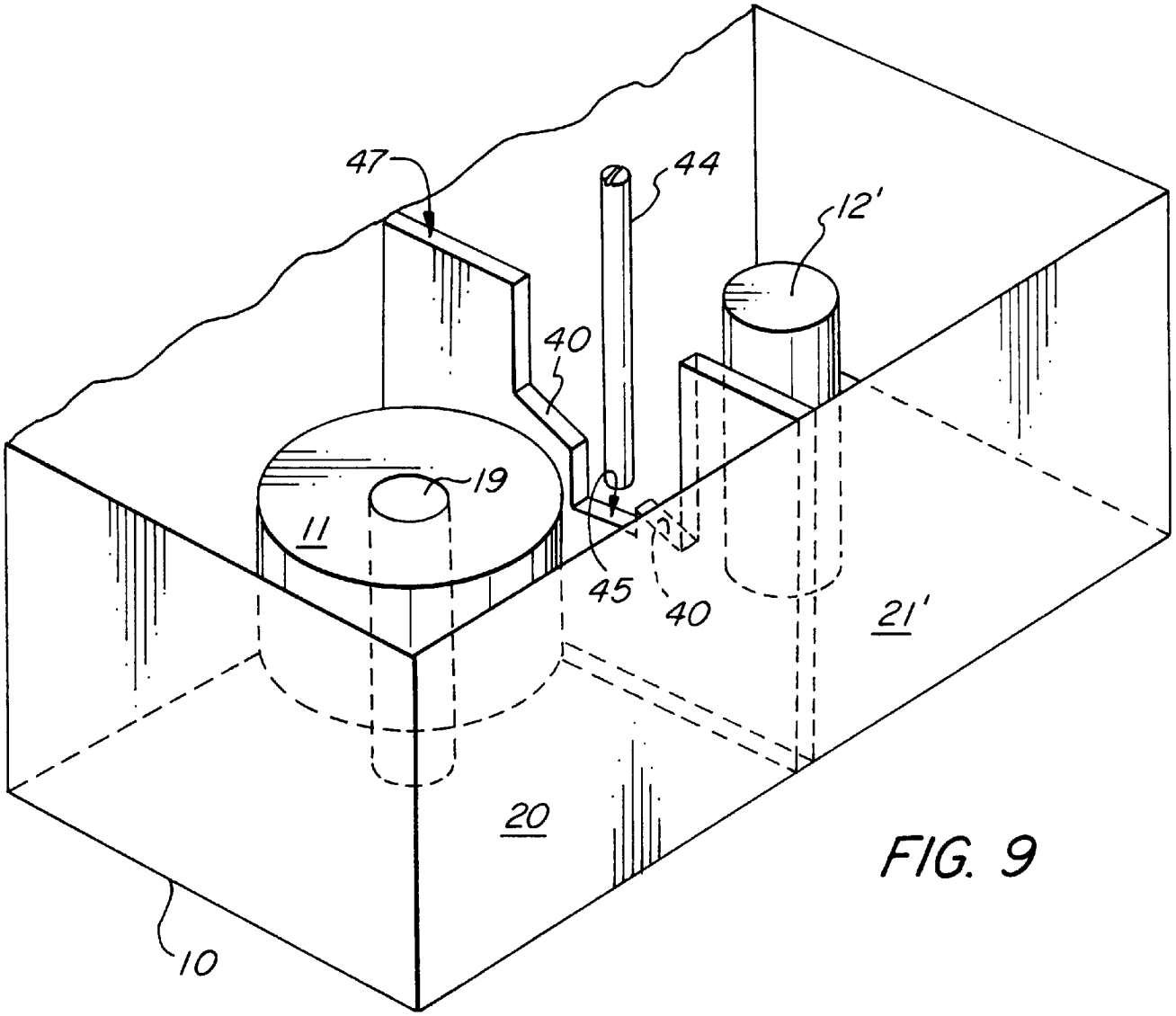
FIG. 9 is a perspective view corresponding to the cross-sectional views of FIGS. 6–8.

Referring now to FIG. 1B, in another aspect of the present invention, the magnetic or electric field in one dissimilar cavity is gradually twisted into the orientation permitted in the other cavity using only a coupling screw 31 piercing a rectangular window 35 in partition wall 33 of coupling structure 30. The coupling screw 31 here plays the role of the guide surface 40 of FIG. 1A. To provide adjustment of the coupling, the coupling screw 31 extends from outside the filter through a sidewall (34 or 36) of the coupling structure 30 into the rectangular window 35 making a coupling angle θ with respect to the axis of either of the two parallel cavity posts 11 and 12' (see FIGS. 6–9), the same coupling angle θ as the guide surface 40 makes in the non-rectangular window embodiment. As in the non-rectangular window embodiment (FIG. 1A), where coupling is increased by turning the tuning screw 44 so that it extends further into the notch 45, in the angled screw embodiment, the coupling is increased by turning the angled coupling screw 31 so that more of it extends into the rectangular window 35.

And just as in the first embodiment, this angled coupling screw embodiment can adapt either the magnetic field either positively or negatively, from one cavity to the next. The coupling angle θ and orientation of the coupling structure shown in FIG. 1B adapts the magnetic field in a positive sense, and corresponds directly to the coupling angle θ and orientation of the coupling structure of FIG. 1A (shown in relationship to the rest of the filter in FIGS. 6–9). To provide negative coupling, the angled coupling structure 30 need only be rotated 90° and put back in the filter, or, alternatively, the angled coupling screw 31, instead of piercing wall 34, can be made to pierce wall 36 after first being rotated through 90°. This is shown in FIG. 1B by the phantom angled coupling screw 37.

In either embodiment, in the case of coupling dissimilar cavities with parallel posts, the coupling angle can vary substantially from 45 degrees, depending on the kind of coupling desired and the precise geometry of the posts in each cavity. Generally, the coupling angle will lie in a range of from approximately 10 degrees to approximately 80 degrees, the larger coupling angle corresponding to where the metallic resonator dominates the ceramic resonator in its effect.

It is to be understood that the above described arrangements are only illustrative of the application of the principles of the present invention. In particular, the present invention allows for coupling the various stages of a multi-stage filter including coupling similar physically adjacent cavities (with parallel or perpendicular cavity posts). Moreover, the present invention can couple two cavities resonant at slightly different frequencies, and so create a bandpass or very wide band filter with good (low) spurious performance if the filter includes dissimilar cavities.

Although two cavities are shown for the two disclosed embodiments, the present invention could be used for filters with more than two cavities with a disclosed coupling structure between each physically adjacent pair of cavities. Numerous other modifications and alternative arrangements may be devised by those skilled in the art without departing from the spirit and scope of the present invention, and the appended claims are intended to cover such modifications and arrangements.

What is claimed is:

1. A coupling structure, for electromagnetically coupling two cavity resonators each having conducting surfaces that define a cavity, the cavities separated by a partition wall having a window therethrough for coupling electromagnetic energy between the cavities, the electromagnetic energy in a form including a magnetic field in each cavity, the cavity of each cavity resonator constructed so as to have only certain resonant modes and so allow only certain orientations of the magnetic field within the cavity, and the two cavity resonators disposed so that the magnetic fields in the two cavities are substantially non-aligned, the coupling structure comprising a conductive guide surface positioned in the plane of the partition wall at an orientation so that the magnetic field in each cavity has a substantially non-zero projection onto the guide surface.

2. A coupling structure as in claim 1 above, wherein the guide surface is the surface of an angled coupling screw piercing an outer side wall of the partition and extending into the window of the partition.

3. A coupling structure as in claim 1 above, wherein the window of the partition is non-rectangular and the guide surface is the surface of an edge of the non-rectangular window.

4. A coupling structure as in claim 3 above, wherein the guide surface has a notch and the coupling structure further comprises a tuning screw piercing an outer side wall of the partition and extending toward the notch.

5. A coupling structure as in claim 1 above, wherein the cavity resonators are dissimilar and each cavity has a post with longitudinal axis parallel to the longitudinal axis of the post in the other cavity.

6. A coupling structure as in claim 5 above, wherein the guide surface is the surface of an angled coupling screw piercing an outer side wall of the partition and extending into the window of the partition.

7. A coupling structure as in claim 5 above, wherein the window of the partition is non-rectangular and the guide surface is the surface of an edge of the non-rectangular window.

8. A coupling structure as in claim 7 above, wherein the guide surface has a notch and the coupling structure further comprises a tuning screw piercing an outer side wall of the partition and extending toward the notch.

9. An improved coupling structure for coupling two cavity resonators each having conducting surfaces that define a cavity, including for each cavity a surface of a partition wall, the surface being different for each cavity, the partition wall separating the two cavities and having a window therethrough for coupling electromagnetic energy between the cavities, the electromagnetic energy in a form including a magnetic field in each cavity, each cavity resonator supporting only certain resonant modes in its cavity and so allowing in its cavity only certain orientations of the magnetic field within its cavity, and the two cavity resonators such that the magnetic field at the partition in one of the two cavities is substantially non-aligned with the magnetic field at the partition in the other of the two cavities, wherein the improvement comprises having the coupling structure include an elongated conductive guide surface in the plane of the partition wall, the elongated conductive guide surface lying at an angle that is substantially intermediate between an allowed orientation of the magnetic field in one of the two cavities and an allowed orientation of the magnetic field in the other of the two cavities.

* * * * *